US011108149B2

(12) United States Patent
Clark et al.

(10) Patent No.: US 11,108,149 B2
(45) Date of Patent: Aug. 31, 2021

(54) RADOME, REFLECTOR, AND FEED ASSEMBLIES FOR MICROWAVE ANTENNAS

(71) Applicant: CommScope Technologies LLC, Hickory, NC (US)

(72) Inventors: Steven M. Clark, Dalgety Bay Fife (GB); Brian Lawson, Leven Fife (GB); Allan Mitchell Tasker, Kirkcaldy Fife (GB); Craig Mitchelson, Cumbernauld Fife (GB); Lawrence Bissett, Leven Fife (GB); Ronald Joseph Brandau, Homer Glen, IL (US)

(73) Assignee: COMMSCOPE TECHNOLOGIES LLC, Hickory, NC (US)

( * ) Notice: Subject to any disclaimer, the term of this patent is extended or adjusted under 35 U.S.C. 154(b) by 130 days.

(21) Appl. No.: 16/312,835

(22) PCT Filed: Jun. 28, 2017

(86) PCT No.: PCT/US2017/039635
§ 371 (c)(1),
(2) Date: Dec. 21, 2018

(87) PCT Pub. No.: WO2018/009383
PCT Pub. Date: Jan. 11, 2018

(65) Prior Publication Data

US 2019/0165463 A1 May 30, 2019

Related U.S. Application Data

(60) Provisional application No. 62/358,298, filed on Jul. 5, 2016.

(51) Int. Cl.
*H01Q 1/42* (2006.01)
*H01Q 15/16* (2006.01)
(Continued)

(52) U.S. Cl.
CPC ..... *H01Q 1/421* (2013.01); *H01Q 1/02* (2013.01); *H01Q 1/42* (2013.01); *H01Q 1/425* (2013.01);
(Continued)

(58) Field of Classification Search
CPC ..... H01Q 1/421; H01Q 1/42; H01Q 15/162; H01Q 15/08; H01Q 1/425; H01Q 19/193; H01Q 15/16; H01Q 19/19
(Continued)

(56) References Cited

U.S. PATENT DOCUMENTS 5,363,115 A * 11/1994 Lipkin ..... H01Q 1/42 343/872
5,625,365 A * 4/1997 Tom ..... G01S 19/36 343/700 MS
(Continued)

FOREIGN PATENT DOCUMENTS

CN 203521604 4/2014
CN 104205497 12/2014
(Continued)

OTHER PUBLICATIONS

Extended European Search Report dated Jan. 3, 2020 in corresponding European Application No. 17824716.9.
(Continued)

*Primary Examiner* — Hai V Tran
(74) *Attorney, Agent, or Firm* — Myers Bigel, P.A

(57) ABSTRACT

A microwave antenna includes an antenna housing and a radome fabric attached to the housing, which is configured to pass microwave electromagnetic signals therethrough. The radome fabric has an opening formed therein. A vent component is attached to the radome fabric so as to cover the opening in the radome fabric when the radome fabric is viewed from an elevation view in a direction parallel to an
(Continued)

axis extending through and perpendicular to the opening in the radome fabric. The vent component is configured to allow air to pass between the atmosphere and the antenna housing.

14 Claims, 10 Drawing Sheets

(51) Int. Cl.
*H01Q 19/19* (2006.01)
*H01Q 15/08* (2006.01)
*H01Q 1/02* (2006.01)
*H01Q 13/16* (2006.01)

(52) U.S. Cl.
CPC ..... *H01Q 15/08* (2013.01); *H01Q 15/16* (2013.01); *H01Q 15/162* (2013.01); *H01Q 19/19* (2013.01); *H01Q 19/193* (2013.01); *H01Q 13/16* (2013.01)

(58) Field of Classification Search
USPC ..... 343/872
See application file for complete search history.

(56) References Cited

U.S. PATENT DOCUMENTS

| | | | | |
|---|---|---|---|---|
| 6,097,346 | A | 8/2000 | Fehrenbach | |
| 6,111,550 | A * | 8/2000 | Miller | H01Q 1/246 343/872 |
| 6,724,349 | B1 | 4/2004 | Baird | |
| 2007/0075075 | A1 | 4/2007 | Jaeger et al. | |
| 2008/0001841 | A1 | 1/2008 | Alberding et al. | |
| 2009/0021442 | A1 | 1/2009 | Syed | |
| 2011/0050516 | A1* | 3/2011 | Glabe | H01Q 1/42 343/705 |
| 2011/0081192 | A1 | 4/2011 | Renilson | |
| 2015/0130671 | A1 | 5/2015 | Cordone | |
| 2015/0280329 | A1* | 10/2015 | Sanford | H01Q 25/001 343/786 |
| 2016/0172745 | A1 | 6/2016 | Keen et al. | |
| 2016/0172748 | A1* | 6/2016 | Keen | H01Q 1/422 343/872 |
| 2017/0125915 | A1* | 5/2017 | Lebayon | H01Q 19/021 |

FOREIGN PATENT DOCUMENTS

| | | |
|---|---|---|
| EP | 2387809 | 11/2011 |
| EP | 2916387 A1 | 9/2015 |
| JP | 58141603 | 9/1983 |
| WO | 2011007164 | 1/2011 |

OTHER PUBLICATIONS

First Office Action dated Dec. 17, 2019 in corresponding Chinese Application No. 201780041898.9.
Chinese Office Action corresponding to CN 201780041898.9.; dated Jun. 15, 2020 (13 pages, including English translation).
PCT International Search Report dated Dec. 20, 2017 for corresponding PCT International Application No. PCT/US2017/039635 (4 pages).
PCT Written Opinion dated Dec. 20, 2017 for corresponding PCT International Application No. PCT/US2017/039635 (10 pages).
Indian Office Action corresponding to IN 201847046077; dated May 12, 2021 (6 pages).

* cited by examiner

RADOME, REFLECTOR, AND FEED ASSEMBLIES FOR MICROWAVE ANTENNAS

RELATED APPLICATIONS

The present application is a 35 U.S.C. § 371 national phase application of and claims priority to PCT Application PCT/US2017/039635 filed Jun. 28, 2017, which claims priority to U.S. Provisional Patent Application Serial No. 62/358,298, filed Jul. 5, 2016, the disclosure of each of which is incorporated herein by reference in its entirety. The above-referenced PCT Application was published in the English language as international Publication No. WO 2018/009383 A9 on Jan. 11, 2018.

BACKGROUND

The present disclosure relates generally to microwave communications and, more particularly, to antenna structures used in microwave communications systems.

Microwave transmission is the transmission of information or energy by electromagnetic waves whose wavelengths are measured in units of centimeters. These electromagnetic waves are called microwaves. This part of the radio spectrum ranges across a frequency band of approximately 1.0 GHz to approximately 300 GHz. These frequencies correspond to wavelengths in a range of approximately 30 centimeters to 0.1 centimeters.

Microwave communication systems may be used for point-to-point communication because the small wavelength of the electromagnetic waves may allow relatively small sized antennas to direct the electromagnetic waves into narrow beams, which may be pointed directly at a receiving antenna. This may allow nearby microwave communication equipment to use the same frequencies without interfering with each other as lower frequency electromagnetic wave systems may do. In addition, the high frequency of microwaves may give the microwave band a relatively large capacity for carrying information. The microwave band has a bandwidth approximately 30 times that of the rest of the radio spectrum below it. Microwave communication systems, however, are limited to line of sight propagation as the electromagnetic waves cannot pass around hills, mountains, structures, or other obstacles in the way that lower frequency radio waves can.

SUMMARY

In some embodiments of the inventive concept, a microwave antenna comprises an antenna housing and a radome fabric attached to the housing, which is configured to pass microwave electromagnetic signals therethrough. The radome fabric has an opening formed therein. A vent component is attached to the radome fabric so as to cover the opening in the radome fabric when the radome fabric is viewed from an elevation view in a direction parallel to an axis extending through and perpendicular to the opening in the radome fabric. The vent component is configured to allow air to pass between the atmosphere and the antenna housing.

In other embodiments, the vent component comprises a plurality of attachment portions and a plurality of vent portions, the plurality of attachment portions and the plurality of vent portions being arranged in alternating fashion, respectively, around a perimeter of the vent component, where each of the plurality of attachment portions is bonded to the radome fabric and where each of the plurality of vent portions overlaps the radome fabric and is not bonded to the radome fabric so as to be configured to allow the air to pass between the atmosphere and the antenna housing.

In still other embodiments, the plurality of vent portions and the plurality of attachment portions are arranged around an entirety of the perimeter of the vent component.

In still other embodiments, the plurality of vent portions and the plurality of attachment portions are arranged around a first portion of the perimeter of the vent component and a second portion of the perimeter of the vent component is bonded to the radome fabric.

In still other embodiments, the plurality of attachment portions of the vent component are bonded to the radome fabric using one of radio frequency welding, gluing, and stitching.

In still other embodiments, the radome fabric and the vent component comprises a same material.

In still other embodiments, the radome fabric comprises a first material and the vent component comprises a second material different from the first material.

In still other embodiments, the second material is configured to provide greater attenuation to the microwave electromagnetic signals than the first material.

In still other embodiments, a position of the opening in the radome fabric is based on a microwave electromagnetic signal transmission pattern.

In still other embodiments, the vent component comprises a base portion that is attached to the radome fabric, the base portion having an opening therein, and a cover portion that is attached to the base portion and overlaps the opening in the base portion so as to be configured to allow the air to pass between the atmosphere and the antenna housing.

In still other embodiments, the opening in the radome fabric is one of a plurality of openings in the radome fabric and the vent component is one of a plurality of vent components attached to the radome fabric so as to cover the plurality of openings in the radome fabric, respectively, when the radome fabric is viewed from an elevation view in a direction parallel to the axes extending through and perpendicular to the plurality of openings in the radome fabric, the plurality of vent components being configured to allow air to pass between the atmosphere and the antenna housing.

In further embodiments of the inventive concept, an apparatus comprises a first portion of a microwave antenna reflector having a first open end and a second open end, a second portion of a microwave antenna reflector having a first open end and a second open end, a backing ring that is configured to couple the first open end of the second portion of the microwave antenna reflector to the second open end of the first portion of the microwave antenna reflector, where the second open end of the second portion is configured to receive a microwave antenna feed therethrough.

In further embodiments, a thickness of the first portion of the microwave antenna reflector as measured from the first open end to the second open end of the first portion along an axis perpendicular to respective planes defined by the first open end and second open end of the first portion is greater than a thickness of the second portion of the microwave antenna reflector as measured from the first open end to the second open end of the second portion along an axis perpendicular to respective planes defined by the first open end and the second open end of the second portion.

In still further embodiments, the backing ring comprises a plurality of ring segments that are configured to be coupled together.

In still further embodiments, the plurality of ring segments are configured to be coupled together using a plurality of joggle joints.

In still further embodiments, the plurality of ring segments comprises one of pressed steel and pressed aluminum.

In still further embodiments, the plurality of ring segments comprises one of rolled steel and rolled aluminum.

In still further embodiments the backing ring is further configured to couple the first and second portions of the microwave antenna reflector to a microwave antenna support structure.

In other embodiments of the inventive concept, an apparatus comprises a first portion of a microwave antenna reflector having a first open end and a second open end and a second portion of a microwave antenna reflector having a first open end and a second open end, the second portion of the microwave antenna reflector having a backing ring at the first open end of the second portion such that the second portion of the microwave antenna reflector comprises a monolithic structure, where the backing ring of the second portion of the microwave antenna reflector is configured to couple the first open end of the second portion of the microwave antenna reflector to the second open end of the first portion of the microwave antenna reflector and where the second open end of the second portion of the microwave antenna reflector is configured to receive a microwave antenna feed therethrough.

In still other embodiments, the backing ring of the second portion of the microwave antenna reflector is further configured to couple the second portion of the microwave antenna reflector to a microwave antenna support structure.

In further embodiments of the inventive concept, a microwave antenna feed assembly comprises a feed cone comprising a dielectric body and a cap that is connected to the dielectric body, where the dielectric body comprises a polystyrene material and where the cap comprises a cross-linked polystyrene and divinylbenzene material.

In still further embodiments, the microwave antenna feed assembly further comprises a metallic layer on the cap.

In still further embodiments, the cap is connected to the dielectric body by a threaded joint connection.

In still other embodiments of the inventive concept, a microwave antenna feed assembly comprises a feed cone comprising a dielectric body and a metallic splashplate that is connected to the dielectric body, where the splashplate extends beyond an outer perimeter of the dielectric body.

In still other embodiments, the splash plate comprises a monolithic metal structure.

In still other embodiments, the dielectric body comprises injected molded polystyrene.

In still other embodiments, the splashplate comprises one of a stamped metal structure and a machined metal structure.

In still other embodiments, the splashplate is connected to the dielectric body by a threaded joint connection and the splashplate and the dielectric body are connected so as to have a gap formed therebetween.

In further embodiments of the inventive concept, a microwave antenna assembly comprises a feed cone and a boom configured to carry microwave electromagnetic signals therethrough, the feed cone being connected to the boom via a threaded joint connection.

It is noted that aspects described with respect to one embodiment may be incorporated in different embodiments although not specifically described relative thereto. That is, all embodiments and/or features of any embodiments can be combined in any way and/or combination. Moreover, other apparatus, methods, systems, and/or articles of manufacture according to embodiments of the inventive subject matter will be or become apparent to one with skill in the art upon review of the following drawings and detailed description. It is intended that all such additional apparatus, systems, methods, and/or articles of manufacture be included within this description, be within the scope of the present inventive subject matter, and be protected by the accompanying claims. It is further intended that all embodiments disclosed herein can be implemented separately or combined in any way and/or combination.

BRIEF DESCRIPTION OF THE DRAWINGS

Other features of embodiments will be more readily understood from the following detailed description of specific embodiments thereof when read in conjunction with the accompanying drawings, in which.

DETAILED DESCRIPTION

In the following detailed description, numerous specific details are set forth to provide a thorough understanding of embodiments of the present disclosure. However, it will be understood by those skilled in the art that the present invention may be practiced without these specific details. In some instances, well-known methods, procedures, components and circuits have not been described in detail so as not to obscure the present disclosure. It is intended that all embodiments disclosed herein can be implemented separately or combined in any way and/or combination. Aspects described with respect to one embodiment may be incorporated in different embodiments although not specifically described relative thereto. That is, all embodiments and/or features of any embodiments can be combined in any way and/or combination.

Large diameter antennas often feature a fabric radome design manufactured from one material type. This may have the advantage of producing a broadband antenna, but a potential disadvantage is the radome material can suffer from deflections when subjected to wind loading. This may result in restrictions in the antenna design, such as a reduced length feed, additional feed protection, and/or extended shields to prevent or reduce the likelihood of damage occurring if the radome deflects inwardly to make contact with the feed under extreme weather conditions.

Some embodiments of the inventive concept may provide a microwave antenna having a vented radome that may reduce radome deflection by equalizing air pressure at either side of the radome when subjected to high wind speeds. According to some embodiments, an area of radome fabric may be removed and a vent component may be attached, for example, to the inner surface of the radome fabric with discontinuous attachment tabs to allow air to pass from one side of the radome fabric to the other. The vent component may be bonded to the radome material in such a way as to eliminate or reduce moisture ingress to the main antenna shell or housing, for example, by sealing off the lower half of the vent component to the radome fabric. In some embodiments, the vent component and the radome fabric may be joined using RF welding, gluing, stitching or other similar bonding techniques. The vent component may comprise the same material as the radome fabric or, in other embodiments, the vent component and the radome fabric may comprise different materials for enhanced mechanical or electrical properties. When different materials are used, the vent component can be strategically positioned in such a way as to enhance the electrical function of the antenna, such as, for example, positioned so as to attenuate an undesirable transmission side lobe. Additional vents may also be placed on the radome fabric in order to enhance mechanical or electrical function.

Figure 1A:
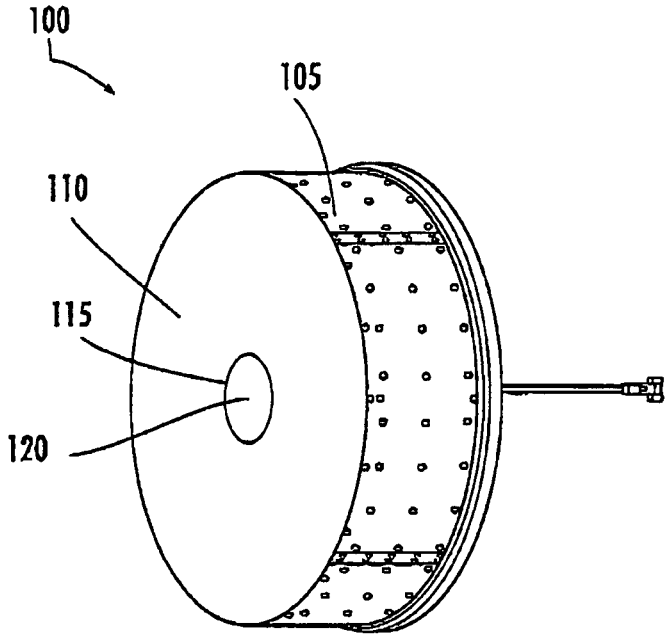
FIG. 1A is a perspective view of a microwave antenna having a vented radome according to some embodiments of the inventive concept.

FIG. 1A is a perspective view of a microwave antenna having a vented radome according to some embodiments of the inventive concept. As shown in FIG. 1A, a microwave antenna 100 comprises an antenna housing 105 with a radome fabric 110 attached to the housing 105. The radome fabric 110 is configured to pass microwave electromagnetic signals therethrough that are transmitted from and received at a feed assembly (not shown) in the housing 105. The radome fabric 110 comprises an opening 115 formed therein with a vent component 120 attached to the radome fabric so as to cover the opening 115 as shown in FIG. 1A.

Figure 1B:
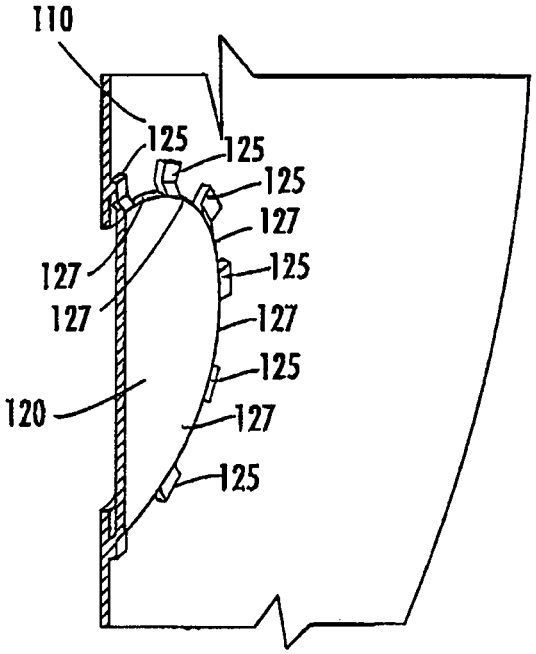
FIG. 1B is a perspective, cross-sectional view of the vent component attached to the radome fabric of FIG. 1A according to some embodiments of the inventive concept.

FIG. 1B is a perspective, cross-sectional view of the vent component 120 attached to the radome fabric 110 of FIG. 1A according to some embodiments of the inventive concept. As shown in FIG. 1B, the vent component 120 may be attached to the inside of the radome fabric 110 (i.e., side of the radome fabric 110 facing the inside of the housing 105) using a plurality of attachment portions or tabs 125 that are spaced apart from one another by a plurality of vent portions 127 that are not affixed to the inner surface of the radome fabric 110. The attachment portions or tabs 125 may extend around an entirety of the perimeter of the vent component 120 and be bonded or attached to the inner surface of the radome fabric 110 using radio frequency welding, gluing, stitching, and/or other suitable bonding mechanisms. Because the vent portions 127 are not affixed to the inner surface of the radome fabric 110, air may flow between the radome fabric 110 and the vent component 120 through the openings defined by the vent portions 127 to reduce the air pressure differential between the atmosphere (e.g., outdoor environment) and the interior of the microwave antenna housing 105, which may reduce the amount of deflection of the radome fabric 110 when subjected to wind loading.

While the vent component 120 may reduce the amount of deflection of the radome fabric 110 due to the vent portions 127, these vent portions 127 may also allow moisture from rain, snow, condensation, and the like to leak into the microwave antenna housing 105. In some embodiments, the tabs 125 along the bottom portion of the vent component 120 (i.e., the portion closest to the ground when the microwave antenna is mounted on a support structure for operation) may be eliminated and this lower portion may be bonded to the radome fabric 110 in like fashion as the tabs 125. Such embodiments may reduce the ingress of moisture into the microwave antenna housing 105 as the effect of gravity may cause rain, snow, condensation, and other moisture to collect towards the bottom portion of the opening 115 in the radome fabric 110 and the bottom portion of the vent component 120.

Figure 2A:
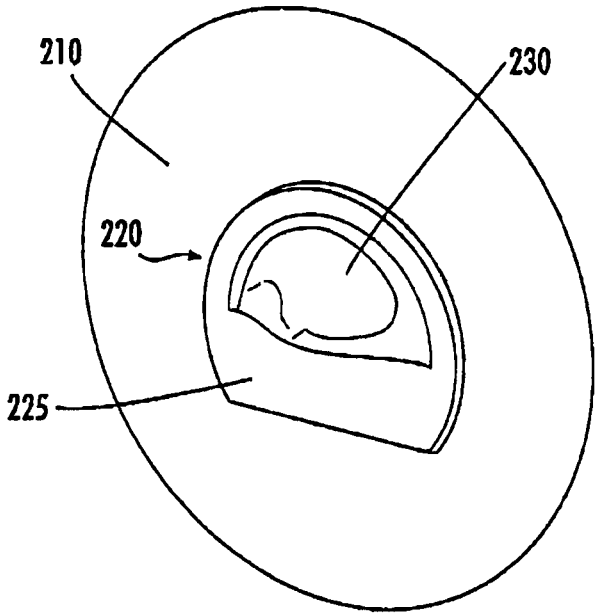
FIG. 2A is a perspective view of a vent component attached to a radome fabric according to further embodiments of the inventive concept.

FIG. 2A is a perspective view of a vent component attached to a radome fabric according to further embodiments of the inventive concept. As shown in FIG. 2A, a vent component 220 may be attached to the outside of the radome fabric 210 (i.e., the side of the radome fabric facing the outside of the housing 105) so as to cover an opening (not shown) in the radome fabric 210. The vent component 220 comprises a base portion 225 that has an opening that aligns or overlaps with an opening (not shown) in the radome fabric 210 and a cover portion 230. The cover portion 230 is attached to the base portion 225 so as to overlap the opening in the base portion 225 to allow air to pass between the atmosphere and the antenna housing through the opening in the radome fabric 210.

Figure 2B:
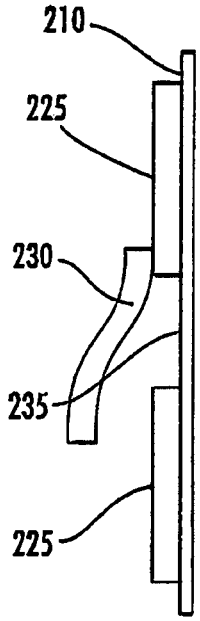
FIG. 2B is a cross-sectional view of the vent component attached to the radome fabric of FIG. 2A according to some embodiments of the inventive concept.

FIG. 2B is a cross-sectional view of the vent component 220 attached to the radome fabric 210 of FIG. 2A according to some embodiments of the inventive concept. As shown in FIG. 2B, the cover portion 230 is attached to the base portion 225 so as to overlap an opening 235 in the base portion 225 while forming a gap between the base portion 225 and the opening 235. Air may flow through this gap and through the opening 235 and a corresponding opening in the radome fabric 210 to reduce the air pressure differential between the atmosphere and the interior of the microwave antenna housing. The cover portion 230 may be configured so that the gap between the cover portion and the base portion 225 faces downward when the microwave antenna is mounted on a support structure for operation to reduce the amount of moisture that may enter into the interior of the microwave antenna housing. The base portion 225 and the radome fabric 210 may be joined and the cover portion 230 and the base portion 225 may be joined using radio frequency welding, gluing, stitching, and/or other suitable bonding mechanisms.

As described above, the vent component may comprise the same material as the radome fabric or, in other embodiments, the vent component and the radome fabric may comprise different materials for enhanced mechanical or electrical properties. Thus, in the embodiments of FIGS. 1A and 1B, the vent component 120 and the radome fabric 110 may comprise the same material or different materials. Similarly, in the embodiments of FIGS. 2A and 2B, the base portion 225, the cover portion 230, and the radome fabric 210 may comprise the same or different materials. For example, the radome fabric 210 may be a fabric, while the cover portion 230 may be made of plastic. The base portion 225 may be made of plastic or fabric. When the cover portion 230 is made of plastic it may be more resistant to environmental forces, such as being blown against the cover portion 230.

When different materials are used to implement the vent component and the radome fabric, the vent component can be strategically positioned in such a way as to enhance the electrical function of the antenna, such as, for example, positioned so as to attenuate an undesirable transmission side lobe. For example, the radome fabric 110/210 may comprise a material that facilitates the passage of microwave electromagnetic signals therethrough while the vent component 120/220 may comprise one or more materials that may provide improved mechanical functionality (e.g., is more effective at preventing ingress of moisture), but provides greater attenuation of microwave electromagnetic signals than the radome fabric 110/210. When strategically placed, however, the attenuation provided by the vent component 120/220 may be advantageous when used to attenuate undesired sidelobe(s) of an electromagnetic signal transmission pattern.

Figure 3:
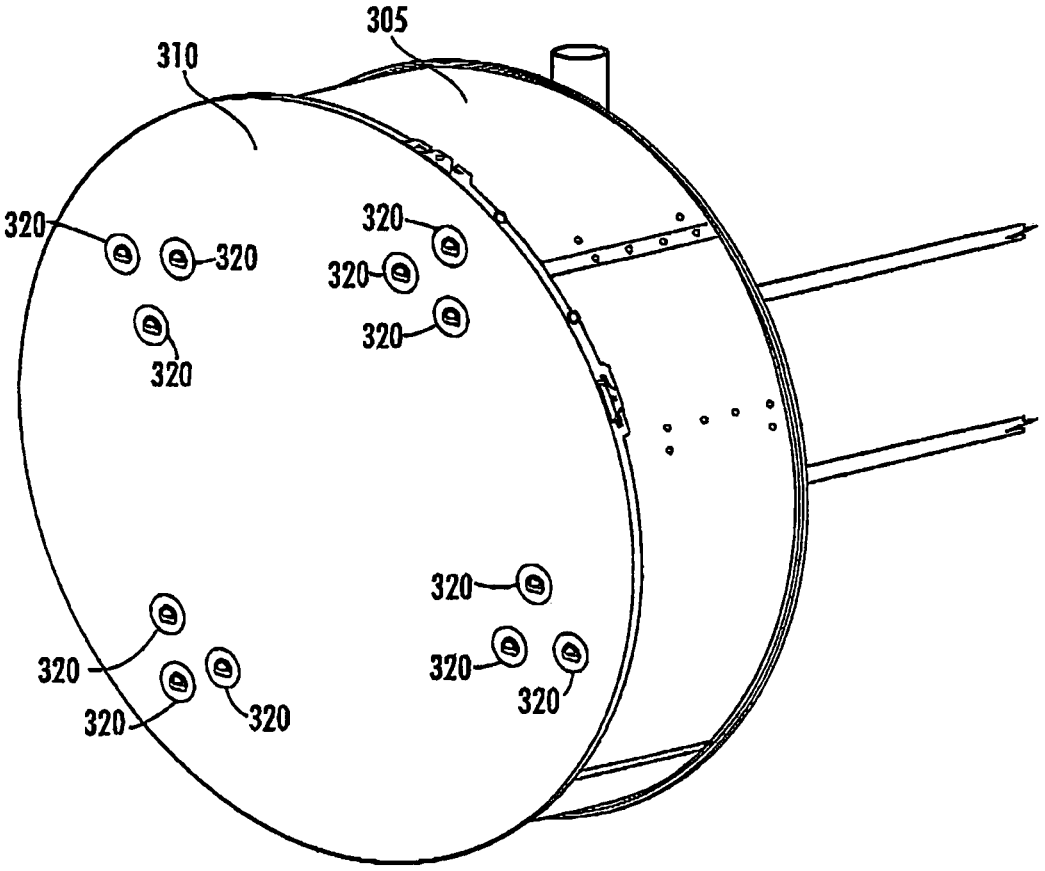
FIG. 3 is a perspective view of a microwave antenna having a vented radome according to further embodiments of the inventive concept.

FIG. 3 is a perspective view of a microwave antenna having a vented radome according to further embodiments of the inventive concept. As shown in FIG. 3, a microwave antenna may have a vented radome with multiple openings and venting components attached thereto. In the example of FIG. 3, a radome fabric 310 is attached to a housing 305 and multiple vent components 320 of the type described with reference to FIGS. 2A and 2B are attached to the radome fabric 310. It will be understood that vent components of the type described with reference to FIGS. 1A and 1B may be used instead of or in addition to the vent components of FIGS. 2A and 2B in accordance with various embodiments of the inventive concept. The vent components 320 may be positioned on the radome fabric 310 based on a microwave electromagnetic signal transmission pattern so as to attenuate particular undesired sidelobe transmissions by using appropriate material(s) to implement the vent components 320.

Figure 4A:
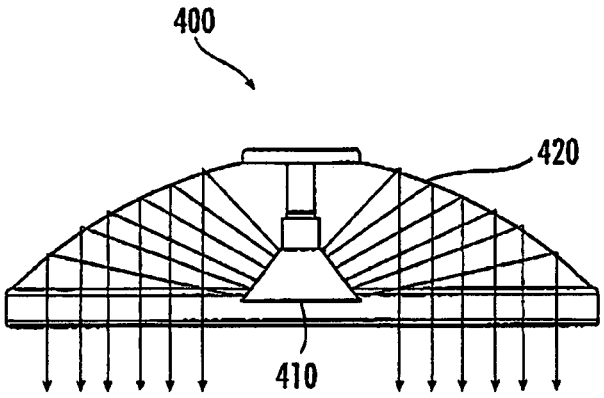
FIG. 4A is a diagram of a microwave antenna including a feed and segmented reflector according to some embodiments of the inventive concept.

FIG. 4A is a diagram of a microwave antenna including a feed and segmented reflector according to some embodiments of the inventive concept. As shown in FIG. 4A, the microwave antenna 400 comprises a feed assembly 410 that is configured to transmit and receive microwave electromagnetic wave signals using the reflector 420. For example, during transmission, the feed assembly transmits the microwave electromagnetic wave signals so that they reflect off the reflector 420 so as to be directed to another microwave antenna. During reception, incoming signals reflect off the reflector 420 and are directed to the feed assembly 410 where they are communicated to a signal processing unit over a boom or signal wave guide.

Antennas featuring a one piece reflector 420 may suffer from high transportation costs and/or restrictions in their design, which may impact electrical performance or other parameters, such as the desire to have a relatively shallow dish. This can impact the design and resulting cost of other components including the feed and electromagnetic shields.

Figure 4B:
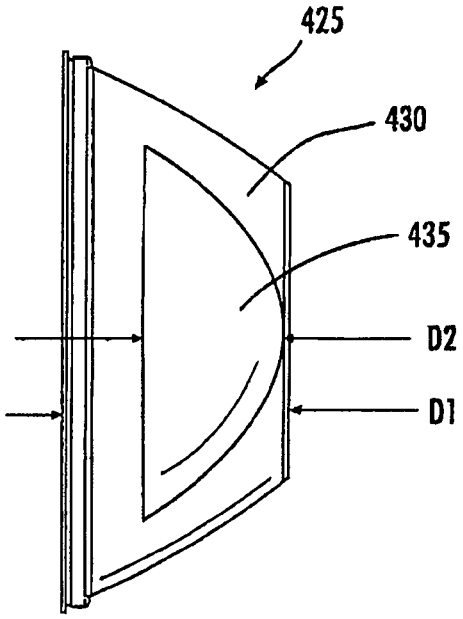
FIG. 4B is a cutaway diagram illustrating a segmented reflector according to some embodiments of the inventive concept.

FIG. 4B is a cutaway diagram illustrating a segmented reflector according to some embodiments of the inventive concept. The segmented reflector 425 comprises a first portion 430 and a second portion 435 where the second portion 435 is configured to fit inside the first portion 430. A thickness D1 of the first portion 430 may be greater than a thickness D2 of the second portion D2 so as to allow the second portion 435 to fit concentrically within the first portion 430. This may allow the segmented reflector 425 to be packaged more efficiently for shipping to an installation site, for example, as the overall shipping size can be reduced.

Figure 4C:
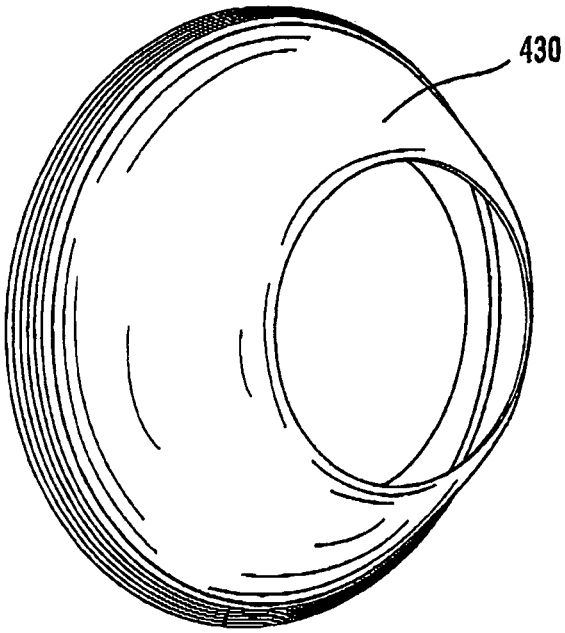
FIG. 4C is a perspective view of one of the portions of the reflector according to some embodiments of the inventive concept.
Figure 4D:
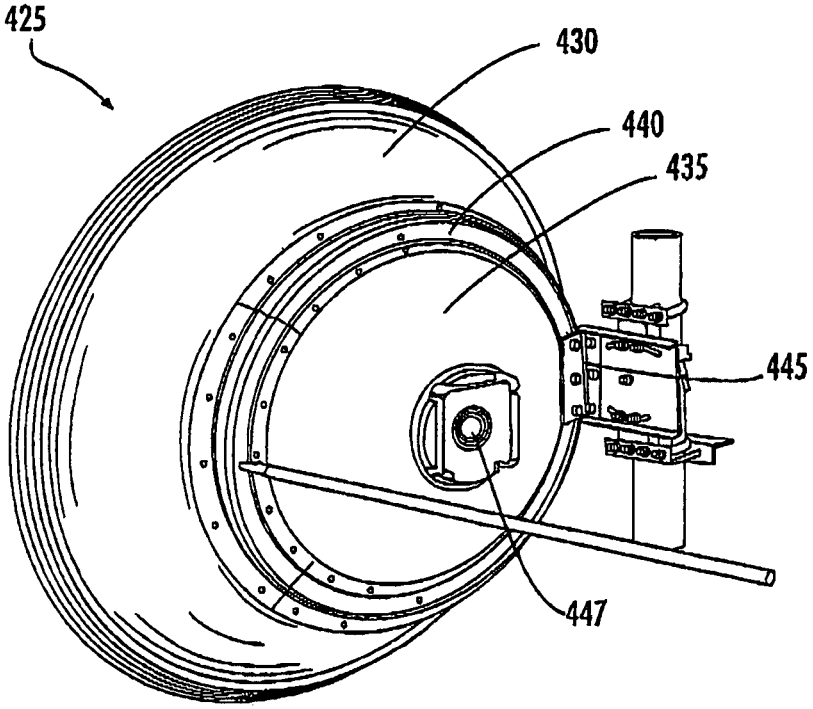
FIG. 4D is a perspective view of the assembled segmented reflector including a segmented backing ring according to some embodiments of the inventive concept.
Figure 4E:
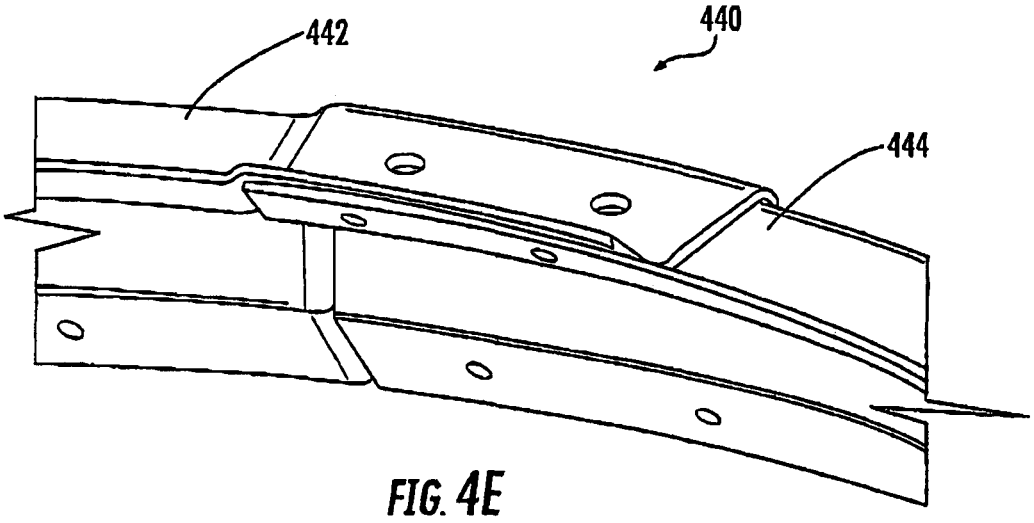
FIG. 4E is a diagram that illustrates the segmented backing ring of FIG. 4D according to some embodiments of the inventive concept.

The two portions of the reflector 430 and 435 may be assembled to create a completed reflector 425. FIG. 4C is a perspective view of the first portion 430 of the segmented reflector 425 according to some embodiments of the inventive concept and FIG. 4D is a perspective view of the assembled segmented reflector 425 including a segmented backing ring according to some embodiments of the inventive concept. As shown in FIG. 4D, the first portion 430 of the segmented reflector 425 is joined to the second portion 435 of the segmented reflector 425 using a segmented backing ring 440. The second portion 435 of the segmented reflector 425 may include an opening 447 through which a microwave antenna feed may be received therethrough. The segmented backing ring 440 may comprise a plurality of ring segments that are configured to be coupled together to secure the first portion 430 of the segmented reflector 425 to the second portion 435 of the segmented reflector 425. As shown in FIG. 4E, individual segments 442 and 444 of the segmented backing ring 440 may be coupled together using, for example, a joggle joint, which can be held in place by one or more screws, bolts, or other suitable fastening technique. It will be understood that a joggle joint is one type of mechanism for joining two segments of the backing ring 440 and that other types of joining mechanisms may be used in accordance with various embodiments of the inventive concept. The segmentation of the backing ring 440 may allow identical sections of the backing ring to be produced with smaller, lower cost, and higher volume tooling, such as steel and/or aluminum pressing. Thus, the various segments of the segmented backing ring 440 may comprise pressed steel, pressed aluminum, rolled steel, rolled aluminum, and/or other suitable materials for securing the first and second portions 430 and 435 of the segmented reflector 425 together. Moreover, as shown in FIG. 4D, the segmented backing ring 440 may also be used to couple the segmented reflector 425 to a microwave antenna support structure 445.

Figure 5A:
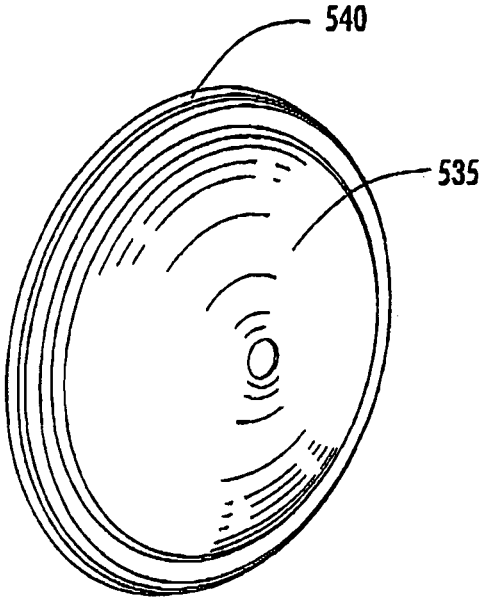
FIG. 5A is a perspective view of a portion of a segmented reflector including a backing ring as part of a monolithic structure according to some embodiments of the inventive concept.
Figure 5B:
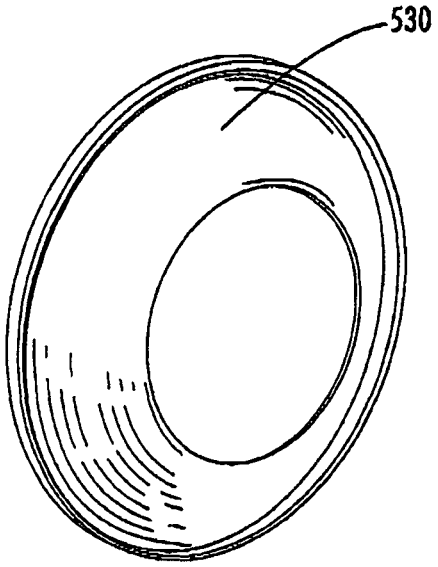
FIG. 5B is a perspective view of one of the portions of the reflector that attaches to the portion illustrated in FIG. 5A according to some embodiments of the inventive concept.

In other embodiments of the inventive concept, a backing ring may be formed into one of the two portions of a segmented reflector to create a monolithic structure comprising both a portion of the segmented reflector and a backing ring. FIG. 5A is a perspective view of a portion of a segmented reflector including a backing ring as part of a monolithic structure according to some embodiments of the inventive concept. As shown in FIG. 5A, the second portion 535 of the segmented reflector is formed with a backing ring 540 as part of a monolithic structure. FIG. 5B is a perspective view of a first portion 530 of the segmented reflector according to some embodiments of the inventive concept and FIG. 5C is a perspective view of the assembled segmented reflector 525 including the first and second portions 530 and 535 attached to a microwave antenna support structure 545.

Figure 5C:
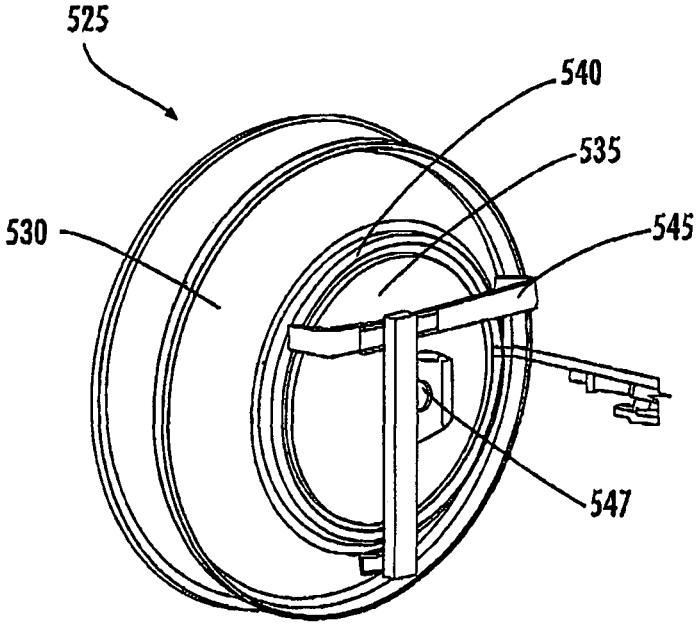
FIG. 5C is a perspective view of the portions of the reflector illustrated in FIGS. 5A and 5B assembled and attached to a microwave antenna support structure according to some embodiments of the inventive concept.
Figure 5D:
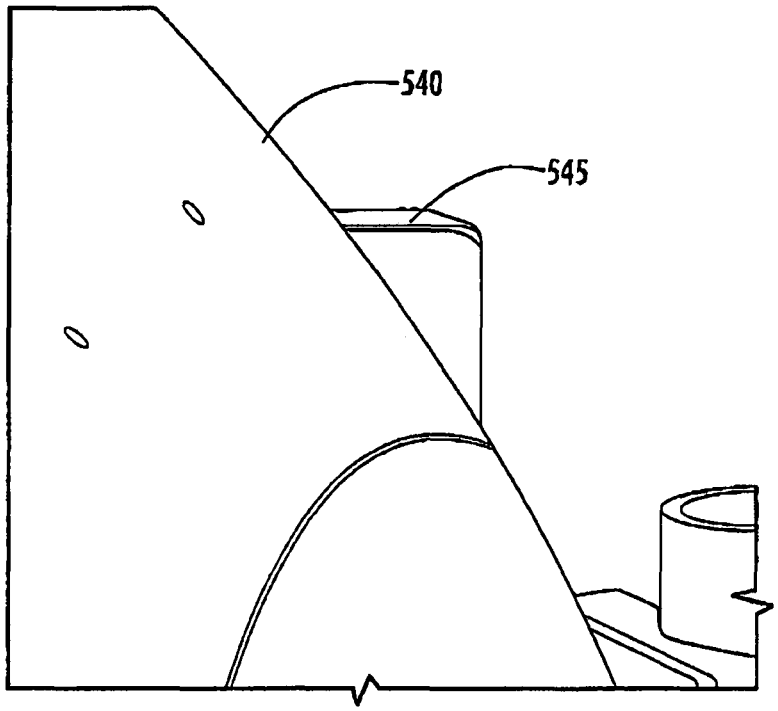
FIG. 5D is a perspective view of the assembled reflector of FIG. 5C attached to the microwave antenna support structure according to some embodiments of the inventive concept.

As shown in FIG. 5C, the first portion 530 of the segmented reflector 525 is joined to the second portion 535 of the segmented reflector 525 using the backing ring 540 that is part of the second portion 535 of the segmented reflector. The second portion 535 of the segmented reflector 525 may include an opening 547 through which a microwave antenna feed may be received therethrough. Moreover, the backing ring 540 may also be used to couple the segmented reflector 525 to a microwave antenna support structure 545 as shown in FIG. 5C and in greater detail in FIG. 5D. Some embodiments of the inventive concept have been described with respect to the backing ring 540 being part of a monolithic structure including the second portion 535 of the segmented reflector. In other embodiments, the backing ring 540 may be formed as part of the first portion 530 of the of the segmented reflector 525 to form a monolithic unit.

As described above with respect to FIG. 4A, microwave antenna feeds are a standard component in microwave antenna designs. The role of a microwave antenna feed is to radiate a transmitted signal from a radio unit onto a reflector to generate a focused beam that propagates in a single direction. The microwave antenna feed also collects microwave electromagnetic signals from another source as they are reflected off the reflector to a focal point. The microwave antenna feed collects these signals and transfers them back to a signal processing unit through a waveguide or boom. A typical feed cone used in a microwave antenna feed includes a dielectric body with a metalized reflective surface that is applied to the surface using such techniques as spraying, brushing, taping, plating, or foiling.

Figure 6:
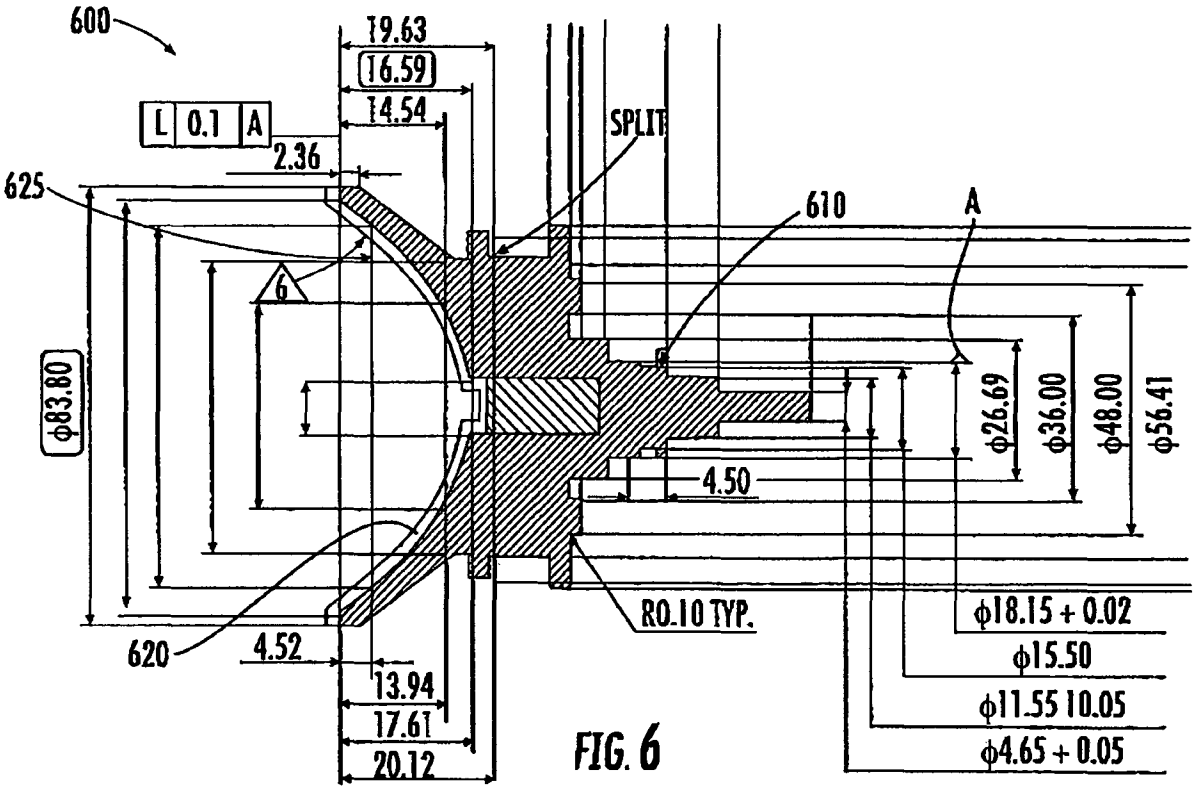
FIG. 6 is a cross-sectional view of a microwave antenna feed assembly including a cap component according to some embodiments of the inventive concept.

FIG. 6 is a cross-sectional view of a microwave antenna feed assembly including a cap component according to some embodiments of the inventive concept. As shown in FIG. 6, a microwave antenna feed assembly 600 comprises a feed cone, which comprises a dielectric body 610 and a cap 620, which is connected to the dielectric body 610 using, for example, a threaded joint connection. Other types of connections can be used to secure the cap 620 to the dielectric body 610 in accordance with various embodiments of the inventive concept. The dielectric body 610 may comprise a polystyrene material, such as a plastic sold under the trade name of Total Lacqrene™. The cap may comprise a cross-linked polystyrene and divinylbenzene material, such as a plastic sold under the trade name Rexolite™. A reflective metallic layer 625 may be formed on the cap 620 using such aforementioned techniques as spraying, brushing, taping, plating, or foiling. The polystyrene used to form the dielectric body may be relatively inexpensive, but may provide cross-linked polystyrene and divinylbenzene may provide a better base on which to form the metallic layer 625.

Figure 7:
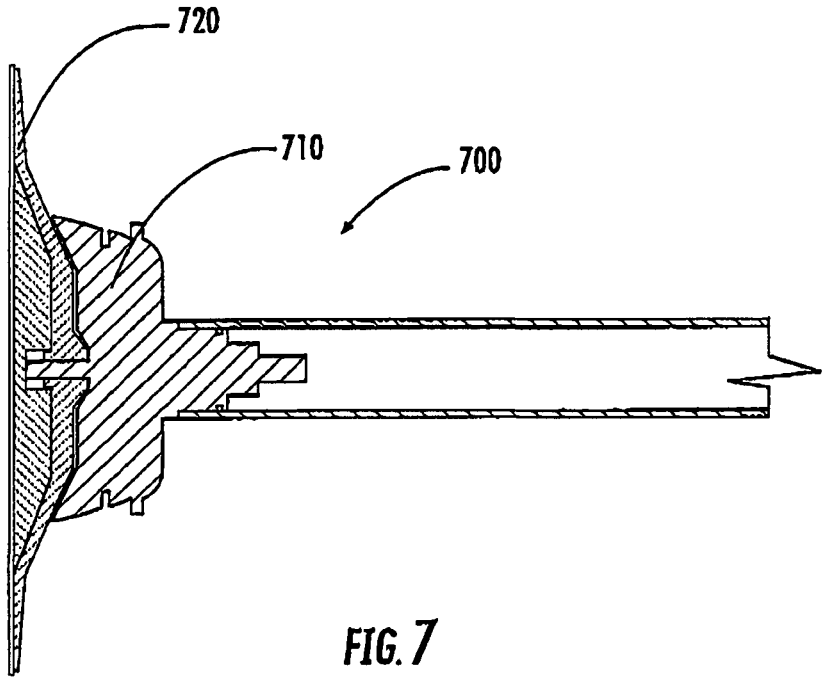
FIG. 7 is a cross-sectional view of a microwave antenna feed assembly including a splashplate according to some embodiments of the inventive concept.

FIG. 7 is a cross-sectional view of a microwave antenna feed assembly including a splashplate according to some embodiments of the inventive concept. As shown in FIG. 7, a microwave antenna feed assembly 700 comprises a feed cone, which comprises a dielectric body 710 and a splashplate 720, which is connected to the dielectric body 710 using, for example, a threaded joint connection with an air gap formed between the dielectric body 710 and the splashplate 720. As shown in FIG. 7, the splashplate 720 extends beyond an outer perimeter of the dielectric body 710 allowing less dielectric material to be used in manufacturing the dielectric body 710. In contrast to the embodiments of FIG. 6 in which a dielectric cap 620 has a metallic layer 625 formed thereon, the splashplate 720 comprises a monolithic metal structure. Thus, there is no need to form a metallic layer on the splashplate 720 to reflect the microwave electromagnetic signals. In accordance with various embodiments of the inventive concept, the relatively small design of the dielectric body 710 may allow the dielectric body 710 to be manufactured using injection molded polystyrene. The splashplate 720 may be a stamped or machined metal component or structure.

Figure 8:
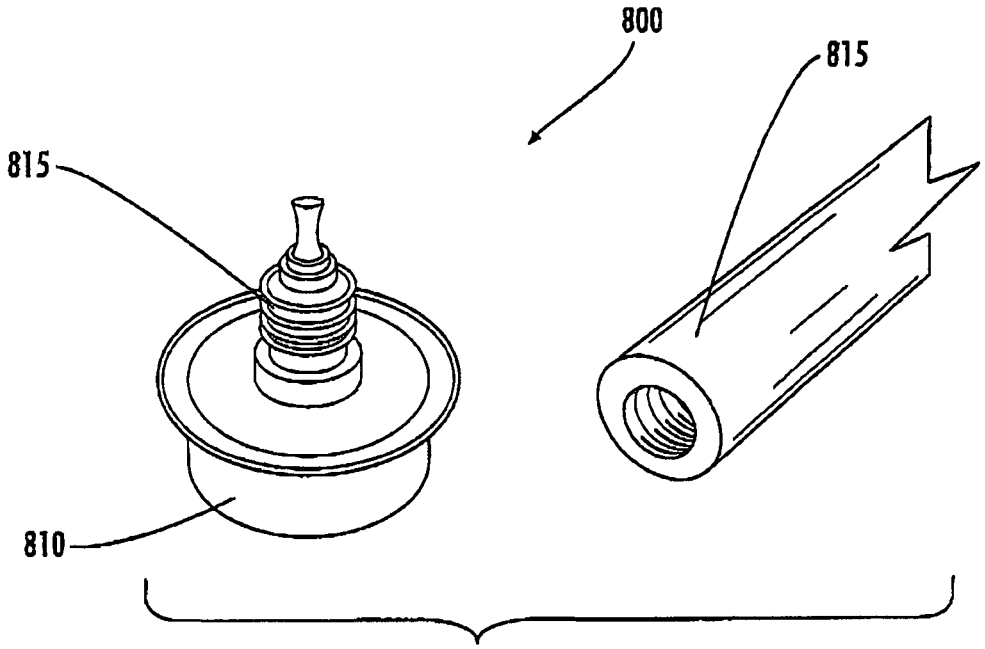
FIG. 8 is a diagram illustrating a microwave antenna feed assembly and boom that connect to one another using a threaded joint connection according to some embodiments of the inventive concept.

Typically a feed cone of a microwave antenna feed assembly is connected to a waveguide or boom using glue, which can result in the feed cone being misaligned with the waveguide or boom during, for example, assembly of the microwave antenna. FIG. 8 is a diagram illustrating a microwave antenna feed assembly and boom that connect to one another using a threaded joint connection according to some embodiments of the inventive concept. As shown in FIG. 8, a microwave antenna assembly comprises a feed cone 810 having a threaded portion 815 extending therefrom that can be mated to a waveguide or boom 820 using a threaded joint connection. Such a threaded joint connection may provide for a more stable interface between the feed cone 810 and the waveguide or boom 820, which may reduce the likelihood of misalignment between the feed cone 810 and the waveguide or boom 820.

FURTHER DEFINITIONS AND EMBODIMENTS

The terminology used herein is for the purpose of describing particular aspects only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Like reference numbers signify like elements throughout the description of the figures.

Embodiments are described herein with reference to cross-sectional and perspective views that are schematic illustrations of idealized embodiments. As such, variations from the shapes of the illustrations as a result, for example, of manufacturing techniques and/or tolerances, are to be expected. Thus, embodiments should not be construed as limited to the particular shapes of regions illustrated herein but are to include deviations in shapes that result, for example, from manufacturing. Therefore, regions illustrated in the drawings are schematic in nature, and their shapes are not intended to limit the inventive concept.

The thicknesses of elements in the drawings may be exaggerated for the sake of clarity. Further, it will be understood that when an element is referred to as being "on" another element, the element may be formed directly on the other element, or there may be an intervening layer therebetween.

Terms such as "top," "bottom," "upper," "lower," "above," "below," and the like are used herein to describe the relative positions of elements or features. For example, when an upper part of a drawing is referred to as a "top" and a lower part of a drawing is referred to as a "bottom" for the sake of convenience, in practice, the "top" may also be called a "bottom" and the "bottom" may also be a "top" without departing from the teachings of the inventive concept.

Furthermore, throughout this disclosure, directional terms such as "upper," "intermediate," "lower," and the like may be used herein to describe the relationship of one element or feature with another, and the inventive concept should not be limited by these terms. Accordingly, these terms such as "upper," "intermediate," "lower," and the like may be replaced by other terms such as "first," "second," "third," and the like to describe the elements and features.

It will be understood that, although the terms "first," "second," etc. may be used herein to describe various elements, these elements should not be limited by these terms. These terms are only used to distinguish one element from another. Thus, a first element could be termed a second element without departing from the teachings of the inventive concept.

The terminology used herein to describe embodiments of the invention is not intended to limit the scope of the inventive concept.

Unless otherwise defined, all terms (including technical and scientific terms) used herein have the same meaning as commonly understood by one of ordinary skill in the art to which this inventive concept belongs. It will be further understood that terms, such as those defined in commonly used dictionaries, should be interpreted as having a meaning that is consistent with their meaning in the context of the relevant art and this specification and will not be interpreted in an idealized or overly formal sense unless expressly so defined herein.

The description of the present disclosure has been presented for purposes of illustration and description, but is not intended to be exhaustive or limited to the disclosure in the form disclosed. Many modifications and variations will be apparent to those of ordinary skill in the art without departing from the scope and spirit of the disclosure. The aspects of the disclosure herein were chosen and described in order to best explain the principles of the disclosure and the practical application, and to enable others of ordinary skill in the art to understand the disclosure with various modifications as are suited to the particular use contemplated.

What is claimed is:

1. A microwave antenna, comprising:

an antenna housing;

a radome fabric attached to the housing and being configured to pass microwave electromagnetic signals therethrough, the radome fabric having an opening formed therein; and a vent component attached to the radome fabric so as to cover the opening in the radome fabric when the radome fabric is viewed from an elevation view in a direction parallel to an axis extending through and perpendicular to the opening in the radome fabric, the vent component being configured to allow air to pass between the atmosphere and the antenna housing;

wherein the vent component comprises a plurality of attachment portions and a plurality of vent portions, the plurality of attachment portions and the plurality of vent portions being arranged in alternating fashion, respectively, around at least part of a perimeter of the vent component;

wherein each of the plurality of attachment portions is bonded to the radome fabric; and wherein each of the plurality of vent portions overlaps the radome fabric and is not bonded to the radome fabric so as to be configured to avow the air to pass between the atmosphere and the antenna housing.

2. The microwave antenna of claim 1, wherein the plurality of vent portions and the plurality of attachment portions are arranged around an entirety of the perimeter of the vent component.

3. The microwave antenna of claim 1, wherein the plurality of vent portions and the plurality of attachment portions are arranged around a first portion of the perimeter of the vent component; and wherein a second portion of the perimeter of the vent component is bonded to the radome fabric.

4. The microwave antenna of claim 1, wherein the radome fabric comprises a first material and the vent component comprises a second material different from the first material.

5. The microwave antenna of claim 4, wherein the second material is configured to provide greater attenuation to the microwave electromagnetic signals than the first material.

6. The microwave antenna of claim 5, wherein a position of the opening in the radome fabric is based on a microwave electromagnetic signal transmission pattern.

7. The microwave antenna of claim 1, wherein the opening in the radome fabric is one of a plurality of openings in the radome fabric; and wherein the vent component is one of a plurality of vent components attached to the radome fabric so as to cover the plurality of openings in the radome fabric, respectively, when the radome fabric is viewed from an elevation view in a direction parallel to the axes extending through and perpendicular to the plurality of openings in the radome fabric, the plurality of vent components being configured to allow air to pass between the atmosphere and the antenna housing.

8. The microwave antenna of claim 1, wherein the radome fabric and the vent component comprise a same material.

9. The microwave antenna of claim 1, wherein the plurality of attachment portions of the vent component are bonded to the radome fabric using one of radio frequency welding, gluing, and stitching.

10. A microwave antenna, comprising:

an antenna housing;

a radome fabric attached to the housing and being configured to pass microwave electromagnetic signals therethrough, the radome fabric having an opening formed therein; and a vent component attached to the radome fabric so as to cover the opening in the radome fabric when the radome fabric is viewed from an elevation view in a direction parallel to an axis extending through and perpendicular to the opening in the radome fabric, the vent component being configured to allow air to pass between the atmosphere and the antenna housing;

wherein the vent component comprises:

a base portion that is attached to the radome fabric, the base portion having an opening therein; and a cover portion that is attached to the base portion and overlaps the opening in the base portion so as to be configured to allow the air to pass between the atmosphere and the antenna housing.

11. The microwave antenna of claim 10, wherein the radome fabric comprises a first material and at least one of the base portion and the cover portion of the vent component comprises a second material different from the first material.

12. The microwave antenna of claim 11, wherein the second material is configured to provide greater attenuation to the microwave electromagnetic signals than the first material.

13. The microwave antenna of claim 12, wherein a position of the opening in the radome fabric is based on a microwave electromagnetic signal transmission pattern.

14. The microwave antenna of claim 10, wherein the radome fabric and the vent component comprise a same material.

* * * * *